US008814290B2

(12) United States Patent
Katagami et al.

(10) Patent No.: US 8,814,290 B2
(45) Date of Patent: Aug. 26, 2014

(54) IMAGE RECORDING DEVICE AND IMAGE RECORDING METHOD

(71) Applicant: Seiko Epson Corporation, Tokyo (JP)

(72) Inventors: Satoru Katagami, Nagano (JP); Akihiro Toya, Nagano (JP); Hiroyuki Santo, Nagano (JP); Hideyuki Nagasawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/847,543

(22) Filed: Mar. 20, 2013

(65) Prior Publication Data

US 2013/0249992 A1 Sep. 26, 2013

(30) Foreign Application Priority Data

Mar. 21, 2012 (JP) ..... 2012-063778

(51) Int. Cl.
*B41J 29/38* (2006.01)

(52) U.S. Cl.
USPC ..... 347/4; 399/390; 399/400

(58) Field of Classification Search
USPC ..... 347/4, 5, 9, 101, 102; 399/390, 400
See application file for complete search history.

(56) References Cited

U.S. PATENT DOCUMENTS 5,444,466 A * 8/1995 Smyczek et al. ..... 347/4
6,922,544 B2 * 7/2005 Ide ..... 399/390
2011/0050824 A1 3/2011 Toya et al.

FOREIGN PATENT DOCUMENTS

JP 2011-194797 A 10/2011

* cited by examiner

*Primary Examiner* — Lam S Nguyen
(74) *Attorney, Agent, or Firm* — Global IP Counselors, LLP

(57) ABSTRACT

An image recording device includes a support member, a recording head, a surface modifying apparatus, a conveyor unit, and a control unit. The surface modifying apparatus executes surface modification processing to modify a surface of the recording medium at a processing position disposed on an upstream side of the support member. The conveyor unit intermittently passes the recording medium through the processing position at a prescribed passage velocity by feeding the recording medium from the upstream side of the conveyance path to the processing position. The control unit is capable of providing a processing execution signal to the surface modifying apparatus, and provides the processing execution signal to the surface modifying apparatus for a prescribed time within a wait time from when passage of the recording medium through the processing position stops until the recording medium starts passing through the processing position at the prescribed passage velocity.

7 Claims, 7 Drawing Sheets

IMAGE RECORDING DEVICE AND IMAGE RECORDING METHOD

CROSS-REFERENCE TO RELATED APPLICATIONS

This application claims priority to Japanese Patent Application No. 2012-063778 filed on Mar. 21, 2012. The entire disclosure of Japanese Patent Application No. 2012-063778 is hereby incorporated herein by reference.

BACKGROUND

1. Technical Field

The present invention relates to technology for recording images by, while intermittently conveying a recording medium, ejecting a liquid on the recording medium when stopped, and specifically relates to technology for executing surface modification processing on a recording medium prior to the liquid being ejected on the recording medium.

2. Related Art

In Japanese Laid-Open Patent Application Publication No. 2011-194797 is noted an image recording device with which a recording head ejects ink on a recording medium supported on a platen to print an image on the recording medium. Specifically with this image recording device, the recording medium is intermittently conveyed over the platen, and the recording head records an image on the recording medium while it is stopped over the platen. In this way, the recording head ejects ink to record an image on the recording medium that is being sequentially conveyed over the platen.

SUMMARY

However, with the aforementioned device that ejects a liquid such as ink on a recording medium to record an image, having the liquid be securely adhered to the recording medium is important. In light of that, it is conceivable to use a surface modifying apparatus such as a corona treater to execute surface modification processing on the recording medium. In specific terms, it is sufficient to arrange the surface modifying apparatus at the upstream side of the recording head in the recording medium conveyance path, and to execute surface modification processing on the recording medium that passes in front of the surface modifying apparatus as the recording medium is being conveyed. By doing this, the recording medium which has undergone surface modification processing is supplied to the recording head, and it is possible to increase the adhesive properties of the liquid ejected by the recording head onto the recording medium.

However, the recording medium which is the subject on which the surface modifying apparatus performs surface modification processing is intermittently conveyed as described above. Therefore, the surface modifying apparatus needs to execute the surface modification processing on the recording medium that is intermittently passing in front of it. At that time, when passage of the recording medium starts, it is ideal to be able to start the surface modification processing immediately, but in actuality, a time difference occurs from when passage of the recording medium starts until the surface modification processing starts.

When this kind of time difference is large, the recording medium passes in front of the surface modifying apparatus as is without surface modification processing being implemented, and there is the risk of a very long area with insufficient surface modification processing being generated on the recording medium. In such a case, if an image is recorded leaving out the area for which surface modification processing is insufficient, the recording medium is consumed wastefully by the amount of this insufficient area, and if an image is recorded on the area for which surface modification processing is insufficient, there is the risk of image inconsistency occurring between the insufficient area and the other areas. Because of that, in either case, it is preferable to keep the area for which surface modification processing is insufficient small.

The present invention was created considering the problems noted above, and an object is to provide technology that ejects liquid onto a recording medium when the recording medium is stopped while being intermittently conveyed to record an image, with the technology able to keep the area for which surface modification processing is insufficient small when implementing surface modification processing on the recording medium.

An image recording device according to one aspect includes a support member, a recording head, a surface modifying apparatus, a conveyor unit, and a control unit. The support member is configured and arranged to support a recording medium conveyed along a conveyance path. The recording head is configured and arranged to eject a liquid on the recording medium while stopped above the support member to record an image. The surface modifying apparatus is configured and arranged to receive a processing execution signal and to execute surface modification processing to modify a surface of the recording medium at a processing position disposed on an upstream side of the support member with respect to the conveyance path. The conveyor unit is configured and arranged to intermittently convey the recording medium from an upstream side of the conveyance path to the support member, and to intermittently pass the recording medium through the processing position at a prescribed passage velocity by feeding the recording medium from the upstream side of the conveyance path to the processing position. The control unit is capable of providing a processing execution signal to the surface modifying apparatus. The control unit is configured to provide the processing execution signal to the surface modifying apparatus for a prescribed time within a wait time from when passage of the recording medium through the processing position stops until the recording medium starts passing through the processing position at the prescribed passage velocity.

An image recording method according to another aspect is a method for ejecting a liquid on a recording medium while stopped above the support member to record an image while the recording medium is being conveyed along a conveyance path. The image recording method includes: executing surface modification processing to modify a surface of the recording medium at a processing position disposed on an upstream side of the support member with respect to the conveyance path by using a surface modifying apparatus that receives a processing execution signal to execute the surface modification processing; intermittently conveying the recording medium from an upstream side of the conveyance path to the support member, and intermittently passing the recording medium through the processing position at a prescribed passage velocity by feeding the recording medium from the upstream side of the conveyance path to the processing position; providing the processing execution signal to the surface modifying apparatus for a passage time from when the recording medium starts passing through the processing position at the conveyance velocity until the recording medium stops; and providing the processing execution signal to the surface modifying apparatus for a prescribed time within a wait time from when passage of the recording medium through the processing position stops until the recording medium starts passing through the processing position at the prescribed conveyance speed.

With the aspects constituted in this way (image recording device, and image recording method), while a recording medium is intermittently conveyed along a conveyance path to a support member, liquid is ejected on the recording medium while stopped above the support member to record an image. Also, a surface modifying apparatus for executing surface modification processing according to a processing execution signal is provided, and surface modification processing can be executed on the recording medium at the processing position on the upstream side from the support member in the conveyance path. In light of that, this aspect executes surface modification processing on the recording medium while suitably giving processing execution signals to the surface modifying apparatus while passing the recording medium through the processing position at a prescribed passage velocity.

In specific terms, the recording medium is intermittently passed through the processing position at a passage velocity by feeding the recording medium from the upstream side of the conveyance path to the processing position in accordance with intermittent conveyance of the recording medium to the support member. Then, the processing execution signals are given to the surface modifying apparatus for the passage time from when passage of the recording medium through the processing position at the passage velocity starts until it stops, and surface modification processing is executed on the recording medium passing through the processing position. At that time, when the passage time starts (specifically, when the recording medium starts passing through the processing position at the passage velocity), if it is not possible for the surface modifying apparatus to start surface modification processing immediately, there was the risk that a large volume of the area for which surface modification processing is insufficient like that described above would be generated.

In contrast to this, with this aspect, processing execution signals are given to the surface modifying apparatus for a prescribed time within the wait time from when the recording medium stops passing through the processing position until it starts passing through the processing position at the conveyance velocity (specifically, the time until the passage time starts). By doing this, it is possible to execute surface modification processing on the recording medium before the passage time, and possible to keep the area for which surface modification processing is insufficient small.

At this time, the image recording device may also be constituted such that the control unit continuously gives processing execution signals to the surface modifying apparatus over the passage time from the wait time by giving the processing execution signals to the surface modifying apparatus for the prescribed time until the wait time ends. With this kind of constitution, it becomes possible to execute surface modification processing continuously from before the start of the passage time until after it starts, and it is possible to more efficiently keep the area for which the surface modification processing is insufficient small.

It is also possible to constitute the image recording device such that the control unit gives the processing execution signals to the surface modifying apparatus for the prescribed time for which the passage of the recording medium through the processing position is stopped during the wait time. In other words, the part of the recording medium stopped at the processing position during the wait time correlates to the part or vicinity thereof for which surface modification processing starts with the next passage time. Therefore, by giving the processing start signal to the surface modifying apparatus at the prescribed time for which the recording medium stops at the processing position during the wait time, it becomes possible to execute surface modification processing in advance on the part or vicinity thereof for which surface modification processing starts at the next passage time. As a result, it is possible to keep the area for which the surface modification processing is insufficient small.

It is also possible to constitute the image recording device such that the conveyor unit, after accelerating the recording medium up to the passage velocity over an acceleration time during the wait time, passes the recording medium through the processing position during the passage time, and the control unit continuously gives processing execution signals to the surface modifying apparatus over the passage time from the wait time by giving the processing execution signals to the surface modifying apparatus for a prescribed time until the acceleration time ends. With this kind of constitution, it is possible to execute surface modification processing continuously from before the start of the passage time until after the start, and possible to more effectively keep the area for which surface modification processing is insufficient small.

The image recording device can also be constituted such that the conveyor unit executes at different timings the operation of doing intermittent conveyance of the recording medium to the support member, and the operation of intermittently passing the recording medium through the processing position. The image recording device can also be constituted such that at this time, the conveyor unit passes the recording medium through the processing position after stopping the recording medium at the processing position for a predetermined time from the start of conveyance of the recording medium to the support member.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1:
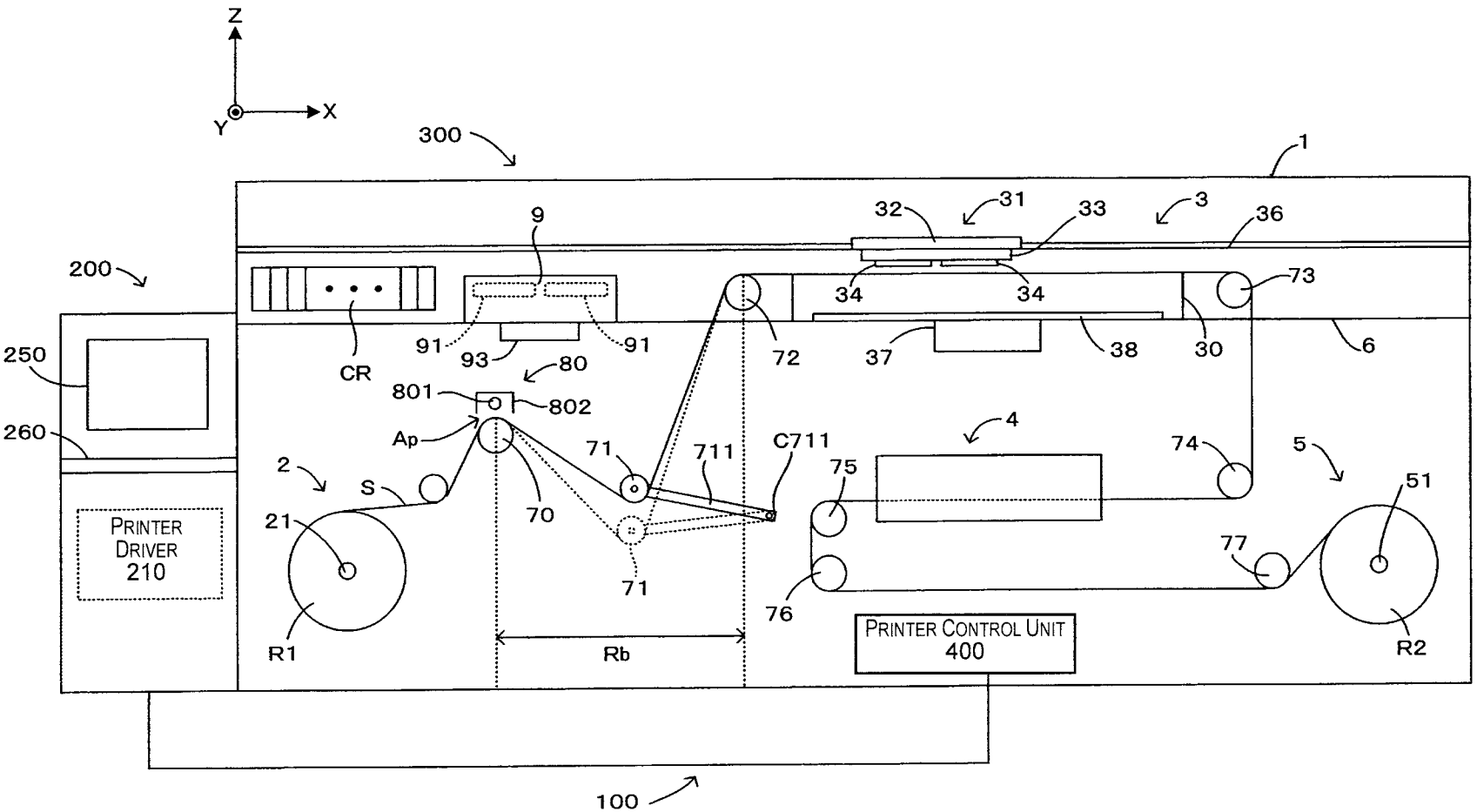
FIG. 1 is a pattern diagram showing an example of a printing system to which the present invention can be applied.

FIG. 1 is a pattern diagram showing an example of a printing system to which the present invention can be applied. Note that in FIG. 1 and the drawings thereafter, when necessary to clarify the arrangement relationship of each unit of the device, the X, Y, and Z orthogonal coordinates having the Z axis as the perpendicular axis are noted together. With the description below, the direction in which each coordinate axis (arrow) faces is the positive direction, and the opposite facing direction is the negative direction, and the Z axis positive side is handled as appropriate as the upper side, and the Z axis negative side as the lower side.

The printing system 100 is equipped with a host device 200 for generating printing data based on image data received from an external device such as a personal computer or the like, and a printer 300 for printing images based on the printing data received from the host device 200. This printer 300 prints an image (forms an image) using the inkjet method on a sheet S while conveying one long sheet S (web) for which both ends are wound in a roll form using the roll-to-roll method.

As shown in FIG. 1, the printer 300 is equipped with a main unit case 1 having a generally rectangular solid shape. Arranged inside the main unit case 1 are an outlet shaft 2 that lets out the sheet S from the roll R1 on which the sheet S is wound, a printing chamber 3 for ejecting ink on the outlet sheet S to perform printing, a drying unit 4 for drying the sheet S on which ink has adhered, and a rewind unit 5 that rewinds the sheet S after drying as a roll R2.

More specifically, the inside of the main unit case 1 is segmented vertically in the Z axis direction by a plate shaped base 6 arranged in parallel to the XY plane (specifically, horizontally), and the upper side of the base 6 is the printing chamber 3. At roughly the center part within the printing chamber 3, a platen 30 is fixed on the top surface of the base 6. The platen 30 has a rectangular shape, and the sheet S is supported from the lower side by the top surface that is parallel to the XY plane. Also, a recording unit 31 performs printing on the sheet S supported on the platen 30.

Meanwhile, the outlet unit 2, the drying unit 4, and the rewind unit 5 are arranged at the lower side of the base 6. The outlet unit 2 is arranged at the lower side (lower left diagonally in FIG. 1) of the X axis negative direction in relation to the platen 30, and is equipped with a freely rotating outlet shaft 21. Also, the sheet S is wound in roll form on this outlet shaft 21, and the roll R1 is supported on it. Meanwhile, the rewind unit 5 is arranged at the lower side of the X axis positive direction (lower right diagonally in FIG. 1) in relation to the platen 30, and is equipped with a freely rotating rewind shaft 51. Also, the sheet S is wound in roll form on the rewind shaft 51, and the roll R2 is supported on it. Also, the drying unit 4 is arranged directly under the platen 30 between the outlet unit 2 and the rewind unit 5 in the X axis direction. The drying unit 4 is slightly to the upper side in relation to the outlet unit 2 and the rewind unit 5.

Then, the sheet S is conveyed along a conveyance path Pc facing the rewind unit 5 from the outlet unit 2, and it passes through the printing chamber 3 and the drying unit 4 in sequence. In specific terms, the sheet S let out from the outlet shaft 21 that the outlet unit 2 is equipped with is guided via rollers 70 and 71 to rollers 72 and 73 inside the printing chamber 3. The roller 70, while winding up the sheet S from the back surface, faces opposite the corona treatment unit 80 described later. Meanwhile, the roller 71 is a movable roller that can move in the Z axis direction.

In specific terms, this movable roller 71 is pivotally supported to be able to rotate freely at one end of a rotation frame 711. Also, this rotation frame 711 is constituted to be able to rotate freely with the rotation shaft C711 of the other end as the center. As a result, the movable roller 71 rotates freely in association with the rotation frame 711 with the rotation shaft C711 as the center. Also, the movable roller 71 constituted in this way is in contact by its own weight from the top side with the sheet S stretched across the roller 70 and the roller 72. Therefore, the movable roller 71 is displaced in the vertical direction according to the reaction received from the sheet S. To say this another way, as exemplified by the solid line and dotted line notations in FIG. 1, the movable roller 71, while being displaced according to changes in the length of the sheet S at the area Rb (buffer area Rb) from the roller 71 to the roller 72, functions as a dancer roller that gives tensile force to the sheet S by winding the sheet S in the concerned buffer area.

Then, the sheet S is guided to the printing chamber 3 interior via this movable roller 71. In the interior of this printing chamber 3 are aligned in sequence two rollers 72 and 73 in the X axis positive direction of the sheet S. Then, the sheet S guided inside the printing chamber 3 is wound onto these two rollers 72 and 73. The rollers 72 and 73 are arranged aligned straight in the X axis direction (specifically, horizontally) so as to sandwich the platen 30, and the respective apexes have their position adjusted so as to have the same height as the top surface of the platen 30 (surface supporting the sheet S). Therefore, the sheet S wound onto the roller 72 moves horizontally (in the X axis direction) while sliding in contact on the top surface of the platen 30 until it reaches the roller 73. Then, the sheet S rolled onto the roller 73 is guided downward.

At the lower side of the roller 73 (lower side from the base 6), two rollers 74 and 75 are aligned in sequence in the X axis negative direction. The sheet S wound onto the roller 74 and the roller 75 is guided in parallel to the X axis direction (specifically, horizontally) between both rollers 74 and 75. Also, the drying unit 4 is arranged between the rollers 74 and 75. Therefore, the sheet S wound onto the roller 74 changes direction to the X axis negative direction, and also passes through the interior of the drying unit 4 until it reaches the roller 75. At the lower side of the roller 75, two rollers 76 and 77 are aligned in sequence in the X axis positive direction. Then, the sheet S wound onto the roller 76 changes direction to the X axis positive direction and reaches the roller 77. Also, the sheet S wound onto the roller 77 is rewound onto the rewind shaft 51 of the rewind unit 5 arranged in the X axis positive direction of the roller 77.

In this way, the sheet S outlet from the outlet unit 2 passes through the printing chamber 3 and the drying unit 4, and is rewound onto the rewind unit 5. Then, various types of processing such as print processing at the printing chamber 3, drying processing by the drying unit 4 and the like are implemented on this sheet S.

The printing process in the printing chamber 3 is executed by a recording unit 31 arranged at the upper side of the platen 30. This recording unit 31 ejects ink, which is supplied by an ink supply mechanism (not illustrated) from an ink cartridge CR arranged at the X axis negative direction end part (left end part in FIG. 1), onto the sheet S using an inkjet method to perform printing. In specific terms, this recording unit 31 is equipped with a carriage 32, a plate shaped support plate 33 attached to the bottom surface of the carriage 32, and a plurality of recording heads 34 attached to the bottom surface of the support plate 33.

Figure 2:
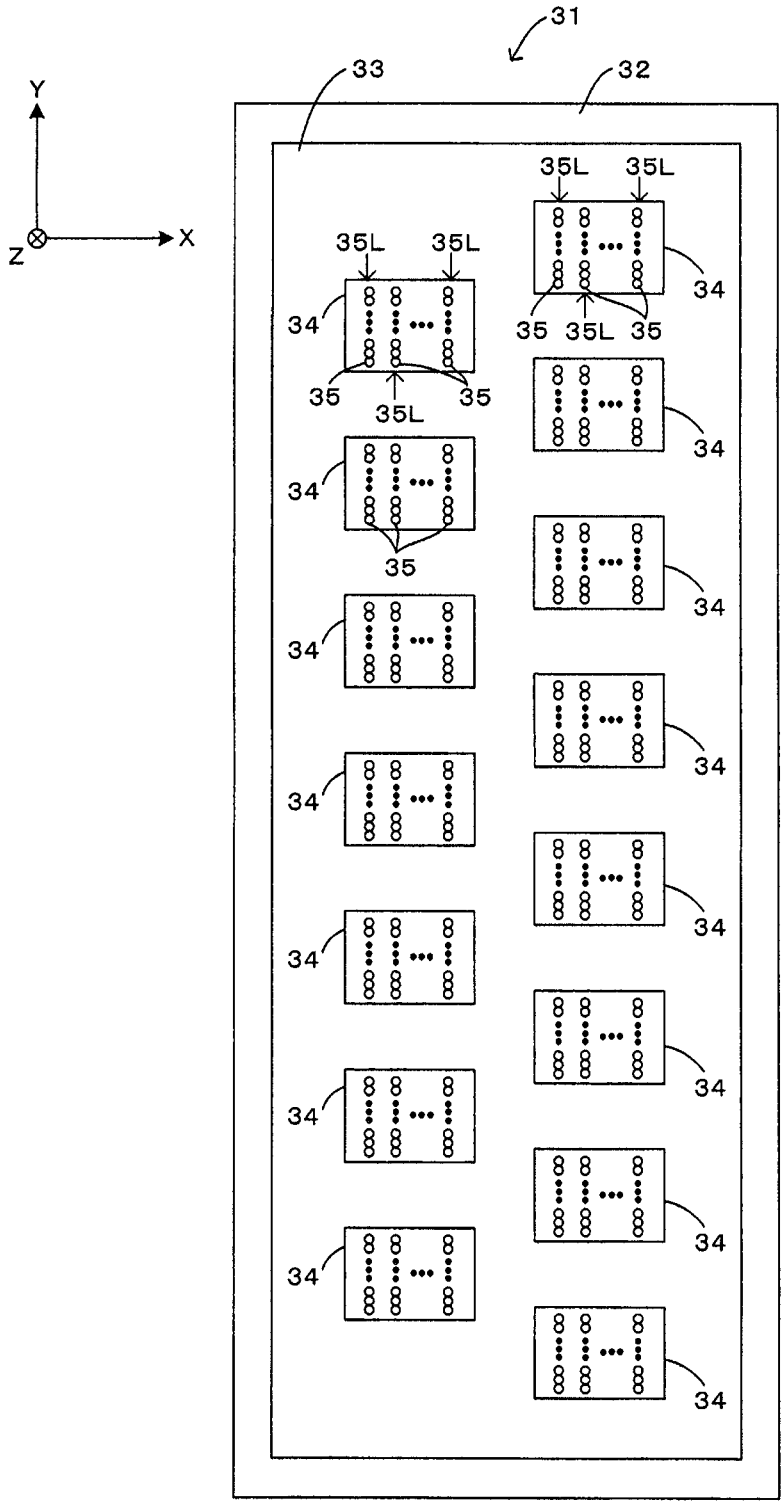
FIG. 2 is a plan view partially showing the constitution of the recording unit.

FIG. 2 is a plan view partially showing the constitution of the recording unit. As shown in FIG. 2, at the bottom surface of the support plate 33, 15 recording heads 34 are aligned in two zigzag rows at an equal pitch in the Y axis direction. These recording heads 34 eject ink from nozzles 35 and are equipped with the same constitutions as each other. In light of that, hereafter, we will give a detailed description of the constitution of one recording head 34 as a representative example.

At the bottom surface of the recording head 34, one nozzle row 35L is constituted by a plurality of (e.g. 180) nozzles 35 aligned in a straight line at equal pitch in the Y axis direction constitute, and a plurality of nozzle rows 35L are aligned at an equal pitch in the X axis direction. The plurality of nozzle rows 35L aligned on the bottom surface of the recording head 34 correspond to mutually different ink colors, and for example when using eight colors of ink, eight rows of nozzle rows 35L are aligned on the bottom surface of the recording head 34. Then, the nozzles 35 belonging to the same nozzle row 35L eject mutually the same color, and meanwhile, the nozzles 35 belonging to different nozzle rows 35L eject mutually different colored inks. Note that the nozzles 35 use the piezo method of ejecting ink outside a tube by applying voltage to a piezo element attached to a micro tube in which ink is clogged to cause deformation.

We will return to FIG. 1 to continue the description. With the carriage 32 of the recording unit 31 constituted as described above, the support plate 33 and the recording head 34 move freely as an integrated unit. In specific terms, a first guide rail 36 extending in the X axis direction is provided inside the printing chamber 3, and when the carriage 32 receives the drive force of the first CR motor Mx (FIG. 3), it moves in the X axis direction along the first guide rail 36. Furthermore, a second guide rail (not illustrated) extending in the Y axis direction is provided inside the printing chamber 3, and when the carriage 32 receives the drive force of a second CR motor My (FIG. 3), it moves in the Y axis direction along the second guide rail.

Then, the carriage 32 of the recording unit 31 is moved two dimensionally within the XY plane in relation to the sheet S which has stopped on the top surface of the platen 30, and printing is executed. In specific terms, with the recording unit 31, while the carriage 32 is being moved in the X axis direction (main scan direction), the operation of ejecting ink on the sheet S (main scan) from the nozzles 35 of the recording head 34 is executed. With this main scan, a plurality of single line images (line images) extending in the X axis direction formed from the ink ejected from one nozzle are aligned with gaps open in the Y axis direction, and a two dimensional image is printed. Then, this main scan and a sub scan by which the carriage 32 moves in the Y axis direction (sub scan direction) are executed alternately, and the main scan is executed a plurality of times (lateral scan method).

In other words, when one main scan is completed, the recording unit 31 performs a sub scan and moves the carriage 32 in the Y axis direction. Subsequently, from the position to which it was moved by this sub scan, the recording unit 31 moves the carriage 32 in the X axis direction (the direction opposite to the previous main scan). By doing this, a line image by the new main scan is formed between the respective plurality of line images already formed by the previous main scan. Then, the main scan and the sub scan are executed alternately. In other words, with this printer 300, ink is ejected from the nozzles 35 while the carriage 32 is moved in the X axis direction, and while changing position in the Y axis direction (sub scan), by the operation of forming the interim generated image consisting of a plurality of line images (main scan) being executed a plurality of times, an image with which the interim generated images are overlapped is formed.

By executing the main scan a plurality of times in this way, one printing is executed. Here, one main scan is called a "pass," and one printing executed by a plurality of passes is called a "frame." Also, the interim generated image formed on the sheet S with one pass is called "one pass image."

The reason for repeatedly alternately performing this kind of main scan and sub scan is to improve the resolution. In other words, by executing passes M times, and overlapping a count of M one pass images, it is possible to obtain one frame amount of an image having M times the resolution of the one pass image. In light of that, the recording unit 31 executes a number of passes according to the resolution of the image to be printed to execute one frame of printing. Incidentally, the carriage 32 can move back and forth in the X axis direction. In light of that, the recording unit 31 executes a plurality of passes efficiently by executing the respective passes of the carriage 32 back and forth.

One frame of printing as described above is repeatedly executed while intermittently moving the sheet S in the X axis direction. In specific terms, a prescribed range across almost the entire area of the top surface of the platen 30 is the printing area. Then, with the distance corresponding to the length in the X axis direction of this printing area (intermittent conveyance distance) as a unit, the sheet S is intermittently conveyed in the X axis direction, and one frame of printing is performed on the sheet S that is stopped on the top surface of the platen 30 during intermittent conveyance. To say this in specific terms, when printing of one frame on the sheet S stopped on the platen 30 has ended, the sheet S is conveyed in the X axis direction by the intermittent conveyance distance, and the unprinted surface of the sheet S stops on the platen 30. Subsequently, one frame of printing is newly executed on this unprinted surface, and when that is completed, the sheet S is again conveyed in the X axis direction by the intermittent conveyance distance. Then, this series of operations is executed repeatedly.

To keep the sheet S that is stopped on the top surface of the platen 30 flat during intermittent conveyance, the platen 30 is equipped with a mechanism for suctioning the sheet S that is stopped on the top surface. In specific terms, a large number of vacuum holes (not illustrated) are opened on the top surface of the platen 30, and a suction unit 37 is attached to the lower surface of the platen 30. Then, by the suction unit 37 operating, negative pressure is generated in the vacuum holes on the top surface of the platen 30, and the sheet S is suctioned to the top surface of the platen 30. Then, the suction unit 37 keeps the sheet S flat by suctioning the sheet S while the sheet S is stopped over the platen 30 for printing, and when printing ends, stops suctioning of the sheet S, so it is possible to convey the sheet S smoothly.

Furthermore, a heater 38 is attached to the lower surface of the platen 30. This heater 38 heats the platen 30 to a prescribed temperature (e.g. 45 degrees). By doing this, the sheet S undergoes primary drying by the heat of the platen 30 in parallel with undergoing the printing process from the recording head 34. Then, by this primary drying, drying of the ink impacted on the sheet S is promoted.

In this way, on the top surface of the platen 30, the sheet S that undergoes one frame of printing as well as primary drying is moved along with intermittent conveyance of the sheet S to a drying unit 4. This drying unit 4 executes heat processing by drying the ink impacted on the sheet S completely using air heated for drying. Then, the sheet S which has undergone this drying processing reaches a rewind unit 5 along with intermittent conveyance of the sheet S, and is wound as a roll R2.

Working as noted above, printing and drying processing are implemented on the sheet S by the recording unit 31 and the drying unit 4. In addition to the recording unit 31 and the drying unit 4 described above, the printer 300 is also equipped with functional units of a corona treatment unit 80 and a maintenance unit 9. Following, we will give a detailed description of the constitution and operation of these.

The corona treatment unit 80 is arranged between the roll R1 of the outlet shaft 21 and the movable roller 71 in the conveyance path Pc, facing opposite the roller 70 sandwiching the sheet S. This corona treatment unit 80 has a corona discharge electrode 801 and an electrode cover 802 that covers the corona discharge electrode 801. Meanwhile, the roller 70 that winds the sheet S from the back surface and faces opposite the corona discharge electrode 801 is a grounded earth roller. Also, the sheet S undergoes corona treatment at the processing position Ap facing opposite the corona treatment unit 80 (said another way, the position at which it is wound on the earth roller 821).

In other words, when discharge bias is applied to the corona discharge electrode 801 from the discharge bias generator 84 (FIG. 3), corona discharge is generated between the corona discharge electrode 801 and the earth roller 821, and corona treatment (surface modification processing) is executed on the surface of the sheet S that is at the processing position Ap. In this way, energy is given to the sheet S surface by the corona discharge, the sheet S surface is modified, and the wetting properties of ink on the sheet S are improved. Then, the sheet S which has undergone this corona treatment is supplied to the platen 30, and undergoes print processing by the recording unit 31. The operation of the corona treatment unit 8 will be described in detail later. The maintenance unit 9 is provided at a position away from the X axis negative direction from the platen 30, and performs maintenance on the recording head 34 that is evacuated in a home position (position directly above the maintenance unit) when not printing. This maintenance unit 9 has 15 caps 91 provided with a one-to-one correlation to the 15 recording heads 34, and a raising and lowering unit 93 that raises and lowers the caps 91.

As the maintenance executed by this maintenance unit 9, there is capping, cleaning, and wiping. Capping is a process of raising the caps 91 using the raising and lowering unit 93, and covering the recording heads 34 in the home position with the caps 91. By doing this capping, it is possible to suppress an increase in viscosity of the ink within the nozzles 35 that the recording head 34 has. Also, cleaning is a process of forcefully ejecting ink from the nozzles 35 by generating negative pressure within the caps 91 with the recording heads 34 in a capped state. By doing this cleaning, it is possible to remove ink for which the viscosity has increased, air bubbles in the ink and the like from the nozzles 35. Wiping is a process of using a wiper (not illustrated) to wipe the surface on which the nozzle 35 openings are aligned on the recording head 34 (nozzle opening formation surface). By doing this wiping, it is possible to wipe away ink from the nozzle opening formation surface of the recording head 34.

Figure 3:
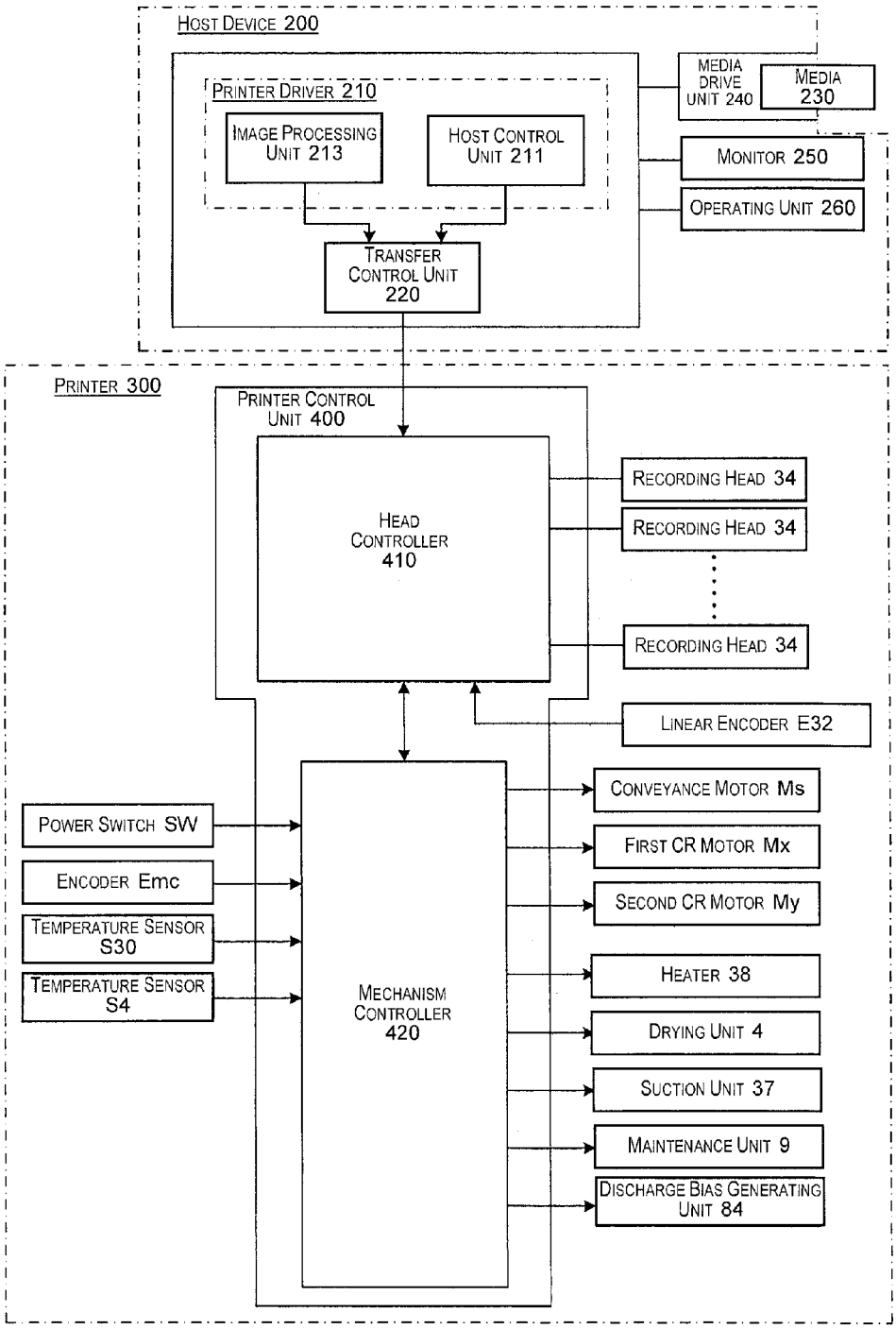
FIG. 3 is a block diagram typically showing the electrical configuration provided with the printing system of FIG. 1.

Above was a summary of the device constitution which the printing system 100 is equipped with. Following, we will add FIG. 3 to FIG. 1 described above and give a detailed description of the electrical constitution that the printing system of FIG. 1 is equipped with. Here, FIG. 3 is a block diagram typically showing the electrical constitution that the printing system of FIG. 1 is equipped with.

As described above, in addition to the printer 300, the printing system 100 is also equipped with a host device 200 that controls this. This host device 200 is constituted by a personal host computer, for example, and in addition to incorporating a printer driver 210 that controls the operation of the printer 300, is also equipped with a transfer control unit 220 that is in charge of the communication function with the printer 300. The printer driver 210 is built by the CPU (Central Processing Unit) that the host device 200 is equipped with executing a program for the printer driver 210.

Also, the host device 200 is equipped with a media driving unit 240 that accesses media 230 in which the printer driver program is stored, and reads that program. As this media 230, it is possible to use various media such as a CD (Compact Disc), DVD (Digital Versatile Disc), USB (Universal Serial Bus) memory or the like.

Furthermore, as an interface with the operator, the host device 200 is equipped with a monitor 250 constituted by a liquid crystal display or the like, and an operating unit 260 constituted by a keyboard, mouse or the like. It is also possible to use a touch panel display as the monitor 250, and to constitute the operating unit 260 with this monitor 250 touch panel. In addition to an image of the printing subject, a menu screen is also displayed on the monitor 250. Therefore, by the operator operating the operating unit 260 while confirming the monitor 250, it is possible to open the print setting screen from the menu screen, and to set various types of printing conditions such as type of print media, print media size, print quality, number of impressions and the like.

The type of print media (specifically, sheet S) is roughly divided into paper and film types. To give specific examples, for the paper type, there is high quality paper, cast paper, art paper, coated paper and the like, and for the film type, there is synthetic paper, PET (Polyethylene terephthalate), PP (polypropylene) and the like. As the print media size, the width of sheet S (width in the Y axis direction) is set. The print quality can be set by selecting one printing mode from the plurality of print modes prepared according to the resolution to be printed. Following are some examples. Specifically, with the aforementioned printer 30, it is possible to change the resolution by changing the pass count executed for one frame. In light of that, it is possible to prepare a plurality of print modes for which the pass count executed with one frame is different, and to make it possible to select a print mode of the pass count according to the resolution to print. By doing this, it is possible to execute printing at the resolution according to the pass count of the selected print mode. It is also possible to constitute this to set the print quality by direct input of the resolution instead of the print mode. The number of impressions is set when printing a plurality of impressions (images) overlapping on the same area of the print media, and the number of impressions to be printed overlapping is set. Incidentally, it is possible to display an image for each impression on the monitor 250 when a plurality of impressions is set.

Then, the printer driver 210 is equipped with the monitor 250 display like that described above, or a host control unit 211 for controlling processing of input from the operating unit 260. In other words, the host control unit 211 displays various types of screens such as the menu screen, print setting screen and the like on the monitor 250, and performs processing on the various screens according to the contents input from the operating unit 260. By doing that, the host control unit 211 generates the control signals needed to control the printer 300 according to input from the operator.

Also, the printer driver 210 is equipped with an image processing unit 213 that implements image processing on image data received from an external device, and generates printing data. In specific terms, image processing such as resolution conversion processing, color conversion processing, halftone processing and the like are performed.

Then, control signals generated by the host control unit 211 or printing data generated by the image processing unit 213 are transferred via a transfer control unit 220 to a printer control unit 400 provided within the main unit case 1 of the printer 300. With this transfer control unit 220, bidirectional serial communication is possible with the printer control unit 400, and control signals or printing data are transferred to the printer control unit 400, and the reply signal to that is received from the printer control unit 400 and sent to the host control unit 211.

The printer control unit 400 is equipped with a head controller 410 and a mechanism controller 420. The head controller 410 is in charge of the function of controlling the recording heads 34 based on the printing data sent from the printer driver 210. In specific terms, the head controller 410 controls the ink eject from the nozzles 35 of the recording heads 34 based on the printing data. At that time, the timing of ejecting the ink from the nozzles 35 is controlled based on the movement of the carriage 32 in the X axis direction. Specifically, a linear encoder E32 for detecting the X axis direction position of the carriage 32 is provided inside the printing chamber 3. Then, the head controller 410 ejects ink from the nozzles 35 at the timing according to the movement of the carriage 32 in the X axis direction by referencing the output of the linear encoder E32.

Meanwhile, the mechanism controller 420 is mainly in charge of the function of controlling the driving of the intermittent conveyance of the sheet S and of the carriage 32. In specific terms, the mechanism controller 420 controls the conveyance motor Ms that drives the sheet conveyor system constituted by the outlet unit 2, rollers 71 to 77, and the rewind unit 5 based on the output of the encoder Emc that detects the rotation of the conveyor motor Ms, and executes intermittent conveyance of the sheet S. Also, by controlling the first CR motor Mx, the mechanism controller 420 executes movements of the carriage 32 in the X axis direction for the main scan, and also, by controlling the second CR motor Mx, executes movement of the carriage 32 in the Y axis direction for the sub scan.

Then, by suitably executing control of the head controller 410 and the mechanism controller 420 while having them synchronized, a number of passes according to the resolution is executed on the intermittently conveyed sheet S, and one frame of printing is executed. By doing this, one frame of an image having the desired resolution is printed on the sheet S.

Also, the mechanism controller 420 can execute various controls in addition to the aforementioned controls for print processing. In specific terms, the mechanism controller 420 detects whether the power switch SW is on or off, and when the power switch SW is on, it executes activation processing of each unit of the printer 300. Also, the mechanism controller 420 executes temperature control such as by doing feedback control of the heater 38 based on the output of the temperature sensor S30 that detects the temperature of the top surface of the platen 30, and doing feedback control of the drying unit 4 based on the output of the temperature sensor S4 that detects the temperature inside the drying unit 4. Furthermore, the mechanism controller 420 is able to execute various operations such as controlling the suction unit 37 to adjust the negative pressure generated in the vacuum holes of the platen 30, and controlling the maintenance unit 9 to execute designated maintenance. In particular, as is described later, the mechanism controller 420 of this embodiment controls the discharge bias generator 84 and executes surface modification processing on the sheet S.

Figure 4:
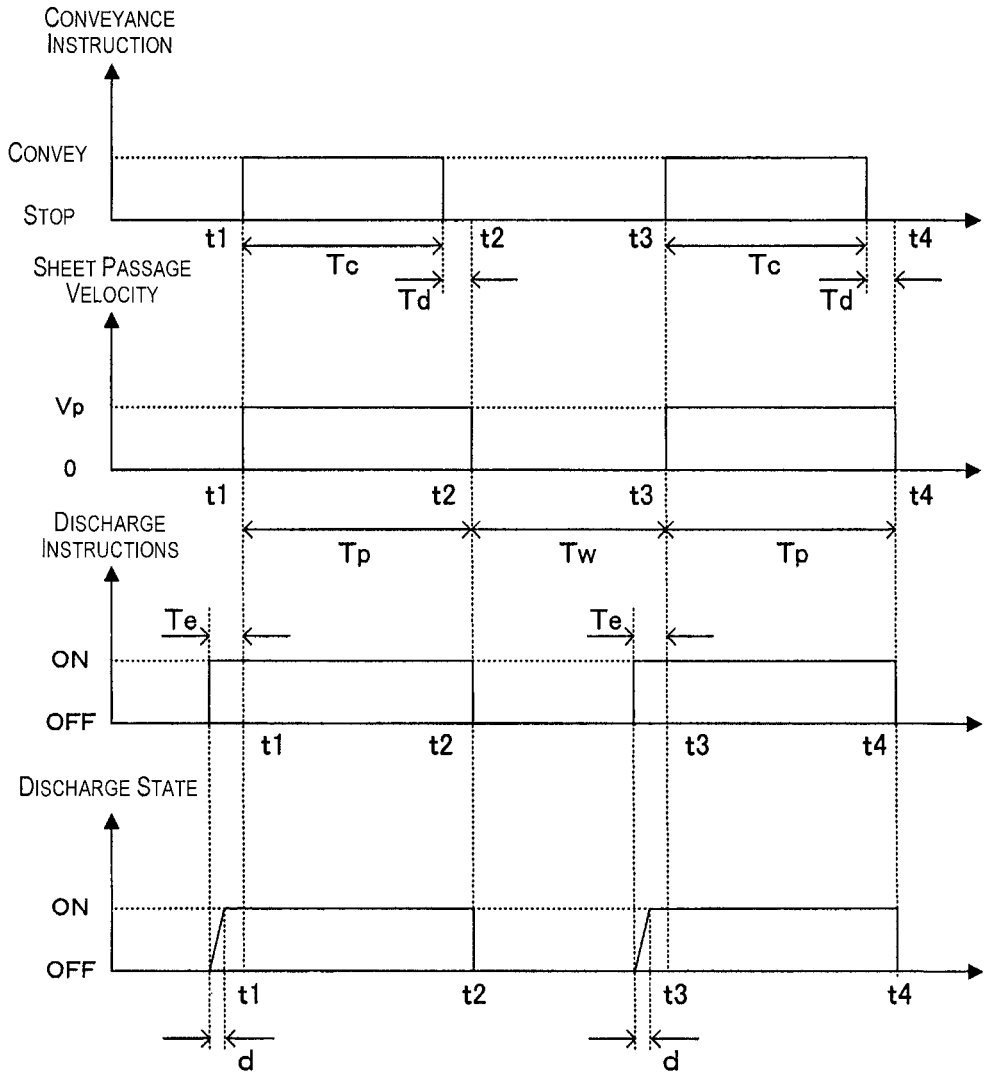
FIG. 4 is a timing chart showing an example of a printing operation executed by a first embodiment.

The above is a summary of the electrical constitution that the printing system of FIG. 1 is equipped with. Following, we will give a detailed description of the printing operation executed with this embodiment. FIG. 4 is a timing chart showing an example of the printing operation executed by the first embodiment. As described above, with the printer 300, printing is executed on the surface of the sheet S that is stopped on the top surface of the platen 30 while the sheet S is intermittently conveyed on the top surface of the platen 30. In light of that, with the printing operation, the conveyance instructions for controlling the intermittent conveyance of the sheet S are output from the mechanism controller 420. In specific terms, with the example shown in FIG. 4, while conveyance instructions are output during prescribed conveyance time Tc from time t1 and prescribed conveyance time Tc from time t3, conveyance instructions are not output during times other than these ("conveyance instructions" graph in FIG. 4).

During the conveyance time Tc in which conveyance instructions are output, the roller 72 (drive roller) rotates forward (clockwise in FIG. 1), and conveys the sheet S from the buffer area Rb at the upstream side of the conveyance path Pc to the platen 30. Also, the outlet shaft 21 also rotates forward (clockwise in FIG. 1) according to the sheet conveyance to the platen 30, and the sheet S is conveyed from the upstream side of the conveyance path Pc via the corona treater 80 to the buffer area Rb. By doing this, the sheet S conveyed from the buffer area Rb to the platen 30 is supplied from the roll R1 of the outlet shaft 21 to the buffer area Rb. At this time, a prescribed volume of the sheet S is stored in the buffer area Rb prior to the conveyance time Tc (buffered), so the velocity Vp at which the sheet S is conveyed from the roll R1 to the buffer area Rb can be set to be lower than the velocity at which the sheet S is conveyed from the buffer area Rb to the platen 30. Then, when output of the conveyance instructions stops, while the roller 72 stops conveying the sheet S, the outlet shaft 21 continues to convey the sheet S for the prescribed time Td, and after the prescribed volume of the sheet S is stored in the buffer area Rb, stops conveying the sheet S (times t2, t4).

Also, the sheet S intermittently conveyed in this way is intermittently passed through the processing position Ap of the corona treater 80 ("sheet passage velocity" graph in FIG. 4). In specific terms, with the example shown in FIG. 4, while the sheet S is passed through the processing position Ap at a prescribed velocity Vp between times t1 and t2 and between times t3 and t4, the sheet S is stopped at the processing position Ap between times t2 and t3. In other words, while the sheet S passes through the processing position Ap toward the downstream side of the conveyance path Pc at velocity Vp during the passage time Tp (between times t1 and t2, and between times t3 and t4), the sheet S stops at the processing position Ap during wait time Tw (between times t2 and t3) (conveyance step).

Then, the mechanism controller 420 gives discharge instructions for controlling whether the corona treater 80 is on or off to the discharge bias generator 84 according to the timing at which the sheet S passes through the processing position Ap. In specific terms, the mechanism controller 420 continuously outputs discharge instructions to the discharge bias generator 84 from the point in time that is a prescribed time Te before the start of the passage time Tp through to the point in time at which that passage time Tp ends, and outputting of the discharge instructions is stopped simultaneous with when that passage time Tp ends. In other words, the discharge instructions output by the prescribed time Te prior to the start of the passage time Tp are continuously output until that passage time Tp ends. Then, the discharge bias generator 84 receives discharge bias output according to the discharge instructions, and the corona treater 80 executes corona discharge (surface modifying step).

Incidentally, as shown in the "discharge state" graph in FIG. 4, for the corona discharge of the corona treater 80, the discharge starts after going through a prescribed delay time d from the start of outputting of discharge instructions, and ends together with the end of outputting of the discharge instructions. In this way, a time difference d occurs from the start of outputting of the discharge instructions until the start of the corona discharge. Therefore, surface modification processing is not executed on the sheet S passing through the processing position Ap during the delay time d from the start of the output of the discharge instructions. Said another way, surface modification processing (corona treatment) is executed only on the sheet S which has passed through the processing position Ap during the time from the start of the corona discharge until the end of sheet S passage time Tp (surface modifying step). Here, the prescribed time Te from outputting of the discharge signals until the start of the passage time Tp is set to be the delay time d or greater required for the corona discharge to start. At that time, the delay time d of the start of the corona discharge can be found in advance by experiment. In specific terms, it is sufficient to find the time from when the discharge instructions are generated until the start of the energy discharge required for surface modification of the sheet S as the delay time d.

As described above, with the first embodiment, while the sheet S is intermittently conveyed to the platen 30 along the conveyance path Pc, ink is ejected on the sheet S that is stopped above the planet 30 to record an image. Also, the corona treater 80 for executing surface modification processing according to discharge instructions is provided, and it is possible to execute surface modification processing on the sheet S at the processing position Ap further to the upstream side from the platen 30 in the conveyance path Pc. In light of that, with this embodiment, by giving discharge instructions to the corona treater 80 as appropriate while the sheet S is passed through the processing position Ap at the velocity Vp, surface modification processing is executed on the sheet S.

In specific terms, the sheet S is intermittently passed through the processing position Ap at the velocity Vp by feeding the sheet S to the processing position Ap from the upstream side of the conveyance path Pc according to the intermittent conveyance of the sheet S to the platen 30. Then, discharge instructions are given to the bias generator 84 for the passage time Tp for which the sheet S starts passing through the processing position Ap at the velocity Vp until it stops, and the corona treater 80 executes surface modification processing on the sheet S that passes through the processing position Ap. In fact, with this embodiment, discharge instructions are given to the discharge bias generator 84 for the prescribed time Te within the wait time Tw (specifically, the time until the passage time Tp starts) from when the sheet S stops passing through the processing position Ap until it starts passing through the processing position Ap at velocity Vp. By doing this, it is possible to execute surface modification processing on the sheet S prior to the passage time Tp, making it possible to keep the area for which the surface modification processing is insufficient small.

In particular, with this embodiment, discharge signals are given to the discharge bias generator 84 for the prescribed time Te until the wait time Tw ends. By doing this, discharge instructions are continuously given to the discharge bias generator 84 from the wait time Tw for the passage time Tp. With this kind of constitution, it is possible to execute surface modification processing continuously from before the start of passage time Tp until after it starts, and it is possible to more effectively keep the area for which the surface modification processing is insufficient small.

Second Embodiment

Figure 5:
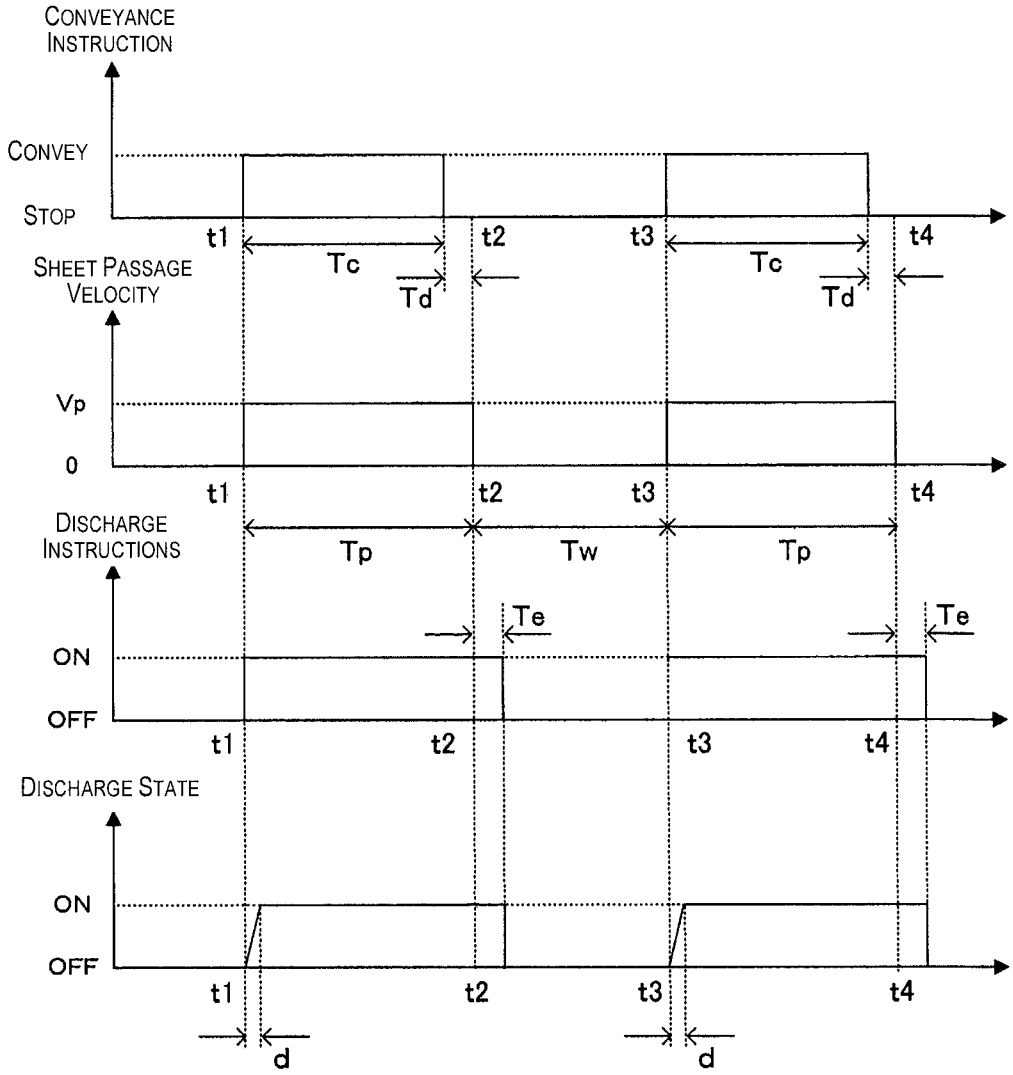
FIG. 5 is a timing chart showing an example of a printing operation executed by a second embodiment.

FIG. 5 is a timing chart showing an example of the printing operation executed with the second embodiment. The difference between the second embodiment and the first embodiment is the timing at which the discharge instructions are output, so hereafter, we will give a description with this difference part as the focus, and for other parts, the correlating code numbers will be given, and descriptions will be omitted as appropriate. It goes without saying that by being equipped with constitutions in common with the first embodiment, that the same effects as those of the first embodiment are also exhibited with the second embodiment.

With the second embodiment, the mechanism controller 420 continuously outputs discharge instructions to the discharge bias generator 84 from the point in time when the passage time Tp starts through the point in time when a prescribed time Te has elapsed from when that passage time Tp ends. In other words, the discharge instructions output simultaneously with the start of the passage time Tp are continuously output until the point in time when the prescribed time Te has elapsed from the end of that passage time Tp. Then, the discharge bias generator 84 receives discharge bias output according to the discharge instructions, and the corona treater 80 executes corona discharge (surface modifying step). The sheet S stops at the processing position Ap at the prescribed time Te after the passage time Tp ends. In other words, at this prescribed time Te, corona treatment is executed on the sheet S that is stopped at the processing position Ap.

In this way, with the second embodiment as well, discharge instructions are given to the discharge bias generator 84 for the prescribed time Te within the wait time Tw from when passage of the sheet S through the processing position Ap stops until passage through the processing position Ap at velocity Vp starts (specifically, the time until the passage time Tp starts). By doing this, it is possible to execute surface modification processing on the sheet S prior to the passage time Tp that occurs later, and possible to keep the area for which the surface modification processing is insufficient small.

In particular, with this embodiment, discharge instructions are given to the discharge bias generator 84 for the prescribed time Te at which the sheet S stops at the processing position Ap during the wait time Tw. In other words, the part of the sheet S stopped at the processing position Ap during wait time Tw correlates to the part or vicinity thereof for which surface modification processing will start in the next passage time Tp. Therefore, by giving discharge instructions to the corona treater 80 for the prescribed time Te for which the sheet S is stopped at the processing position Ap during the wait time Tw, it is possible to execute surface modification processing in advance at the part or vicinity thereof at which surface modification processing will start at the next passage time Tp. As a result, it is possible to keep the area for which the surface modification processing is insufficient small.

Third Embodiment

Figure 6:
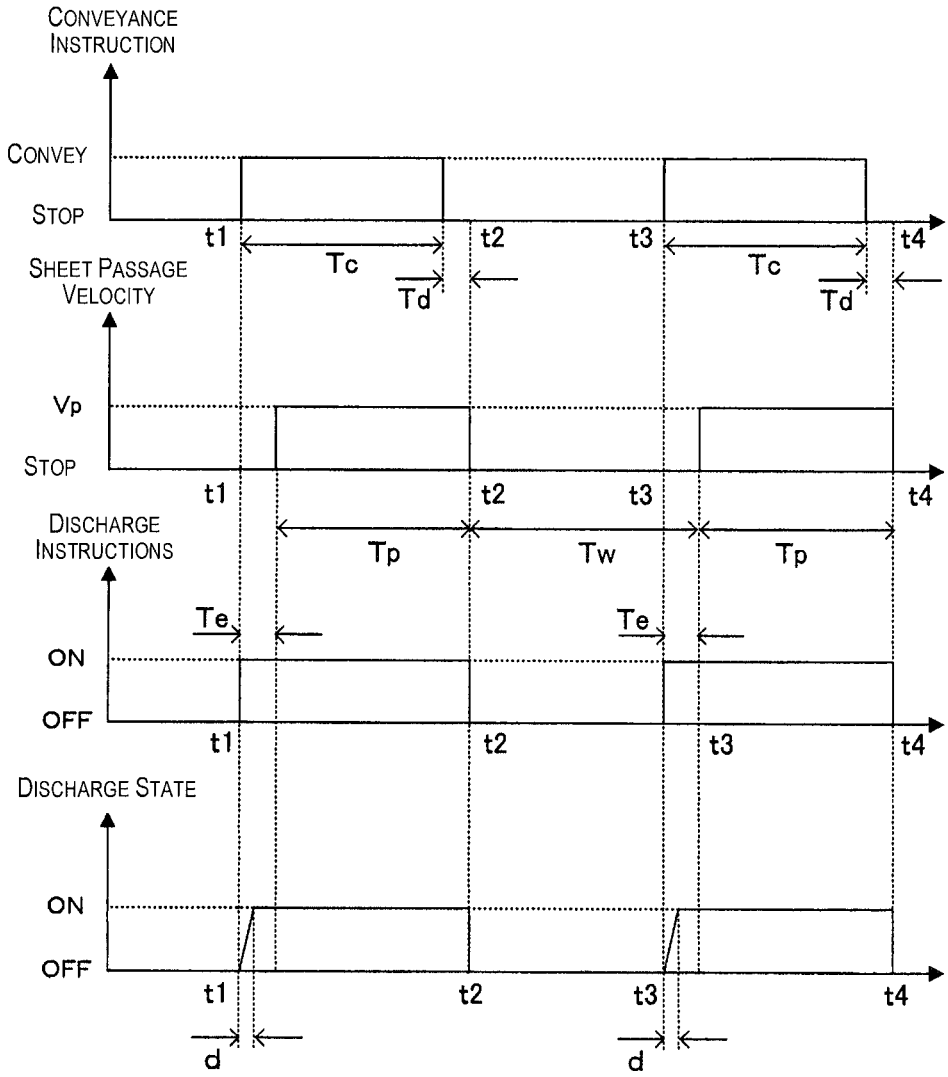
FIG. 6 is a timing chart showing an example of a printing operation executed by a third embodiment.

FIG. 6 is a timing chart showing an example of the printing operation executed with the third embodiment. The difference between the third embodiment and the aforementioned embodiments is the timing at which the sheet S passes through the processing position Ap and the timing at which discharge instructions are output, so hereafter, we will give a description with this difference part as the focus, and for other parts, the correlating code numbers will be given, and descriptions will be omitted as appropriate. It goes without saying that by being equipped with constitutions in common with the aforementioned embodiments, the same effects as those of the aforementioned embodiments are also exhibited with the third embodiment.

With the third embodiment, the outlet shaft 21 does not start conveying the sheet S until the prescribed time Te (>d) has elapsed from the point in time when conveying of the sheet S to the platen 30 by the roller 72 has started (in other words, the point when the conveying time Tc started). Therefore, during this time, the sheet S stored in advance in the buffer area Rb is conveyed to the platen 30. Then, after the prescribed time Te has elapsed from the start of the conveyance time Tc, the outlet shaft 21 starts conveying the sheet S, and the sheet S starts passing through the processing position Ap at the velocity Vp (in other words, the passage time Tp starts). Subsequently, when output of the conveyance instructions stops, while the roller 72 stops conveying the sheet S (in other words, the conveyance time Tc ends), the outlet shaft 21 continues conveying the sheet S for the prescribed time Td, and after a prescribed volume of the sheet S is stored in the buffer area Rb, it stops conveying the sheet S (in other words, the passage time Tp ends).

In contrast to this, outputting of the discharge signals to the discharge bias generator 84 continues from the point in time when the roller 72 starts conveying the sheet S to the platen 30 (in other words, start times t1 and t3 of the conveyance time Tc) until the time when the outlet shaft 21 stops conveying the sheet to the processing position Ap (in other words, the times t2 and t4 when the passage time Tp ends). To say this another way, outputting of the discharge signals starts prior to the start of the passage time Tp by the prescribed time Te, and the outputting of the discharge signals continues until the end of that passage time Tp. Then, the discharge bias generator 84 receives the discharge bias output according to the discharge instructions, and the corona treater 80 executes corona discharge (surface modifying step).

In this way, with the third embodiment as well, discharge instructions are given to the discharge bias generator 84 for the prescribed time Te within the wait time Tw from when the sheet S stops passing through the processing position Ap until it starts passing through the processing position Ap at the velocity Vp (specifically, the time until the passage time Tp starts). By doing this, it is possible to execute surface modification processing on the sheet S prior to the passage time Tp that occurs later, and possible to keep the area for which the surface modification processing is insufficient small.

Fourth Embodiment

Figure 7:
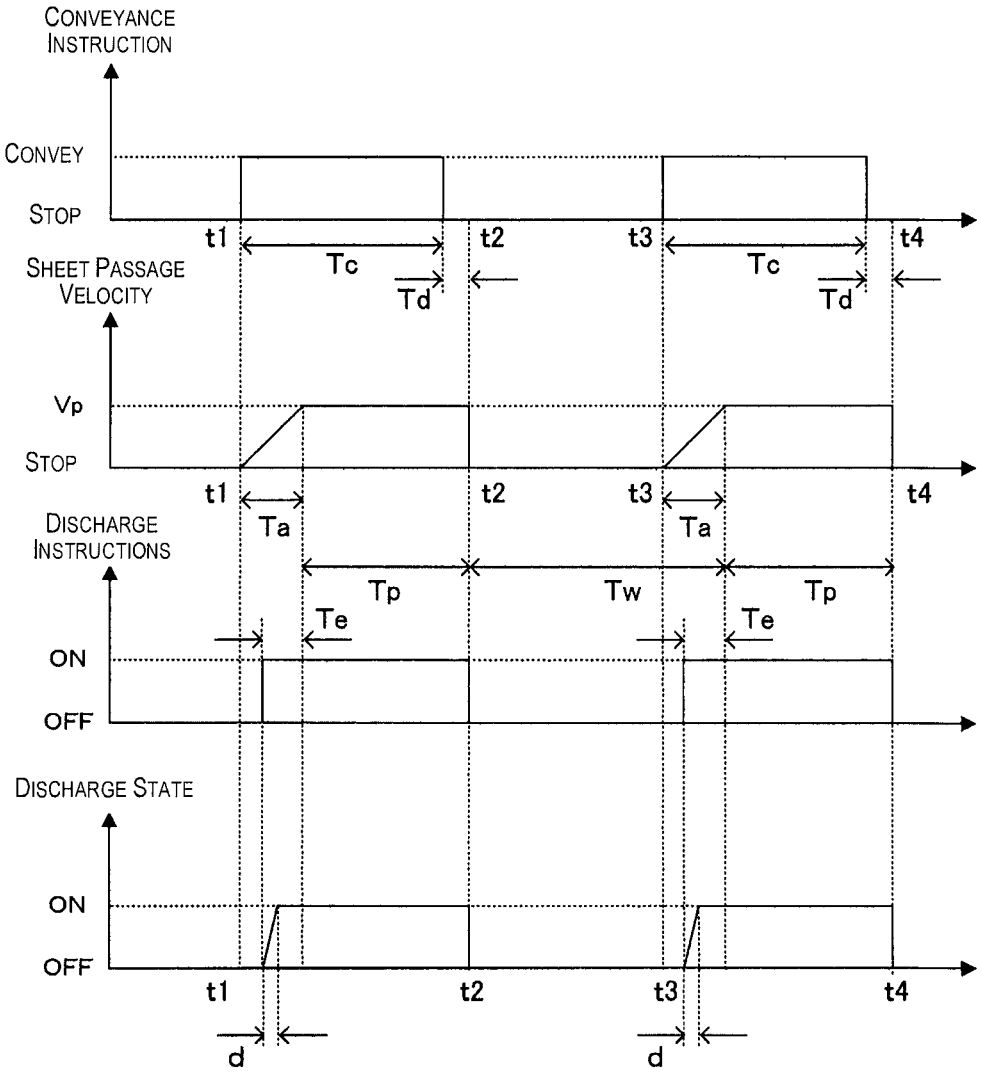
FIG. 7 is a timing chart showing an example of a printing operation executed by a fourth embodiment.

FIG. 7 is a timing chart showing an example of the printing operation executed with the fourth embodiment. The difference between the fourth embodiment and the aforementioned embodiments is the timing of the sheet S passing through the processing position Ap and the timing of outputting the discharge instructions, so hereafter, we will give a description with this difference part as the focus, and for other parts, the correlating code numbers will be given, and descriptions will be omitted as appropriate. It goes without saying that by being equipped with constitutions in common with the aforementioned embodiments, that the same effects as those of the aforementioned embodiments are also exhibited with the fourth embodiment.

With the fourth embodiment, the outlet shaft 21 accelerates the sheet S conveyance velocity from "0" to "Vp" for an acceleration time Ta from the point in time when the roller 72 started conveying the sheet S to the platen 30 (in other words, the start point of the conveyance time Tc). Then, after the acceleration time Ta has elapsed since the start of the conveyance time Tc, the passing of the sheet S through the processing position Ap at a prescribed velocity Vp starts (in other words, the passage time Tp starts). Subsequently, when the outputting of the conveyance instructions stops, while the roller 72 stops conveying the sheet S (in other words, when the conveyance time Tc ends), the outlet shaft 21 continues to convey the sheet S for the prescribed time Td, and after a prescribed volume of the sheet S is stored in the buffer area Rb, stops conveying the sheet S (in other words, passage time Tp ends).

In contrast to this, for the outputting of the discharge signals to the discharge bias generator 84, from a point in time a prescribed time Te (>d) before starting the passage time Tp until the point when that passage time Tp ends, discharge instructions are continuously output to the discharge bias generator 84, and outputting of the discharge instructions stops simultaneously with the end of that passage time Tp. In other words, discharge instructions output by a prescribed time prior to the start of the passage time Tp are continuously output until the end of that passage time Tp. Then, the discharge bias generator 84 receives the discharge bias output according to the discharge instructions and the corona treater 80 executes corona discharge (surface modifying step).

In this way, with embodiment 4 as well, discharge instructions are given to the discharge bias generator 84 for the prescribed time Te within the wait time Tw from when the sheet S stops passing through the processing position Ap until it starts passing through the processing position Ap at the velocity Vp (specifically, the time until the passage time Tp starts). By doing this, it is possible to execute surface modification processing on the sheet S prior to the passage time Tp that occurs later, and possible to keep the area for which the surface modification processing is insufficient small.

In particular, with this embodiment, the outlet shaft 21, after accelerating the sheet S up to the velocity Vp for the acceleration time Ta during the wait time Tw, passes the sheet S through the processing position Ap at the velocity Vp during the passage time Tp. Then, discharge signals are given to the discharge generator 84 for the prescribed time Te until the acceleration time Ta ends, and to say this another way, discharge instructions are continuously given to the discharge bias generator 84 from the wait time Tw through the passage time Tp. With this kind of constitution, it is possible to continuously execute surface modification processing from before the start of the passage time Tp until after the start, and possible to more effectively keep the area for which the surface modification processing is insufficient small.

Other

As described above, the printer 300 correlates to the "image recording device" of the present invention, the sheet S correlates to the "recording medium" of the present invention, the conveyance path Pc correlates to the "conveyance path" of the present invention, the ink correlates to the "liquid" of the present invention, the platen 30 correlates to the "support member" of the present invention, the recording head 34 correlates to the "recording head" of the present invention, the sheet conveyance system constituted by the outlet unit 2, the rollers 71 to 77, and the rewind unit 5 correlates to the "conveyor unit" of the present invention, the corona treater 80 correlates to the "surface modifying apparatus" of the present invention, the processing position Ap correlates to the "processing position" of the present invention, the discharge instruction correlates to the "processing execution signal" of the present invention, the mechanism controller 420 correlates to the "control unit" of the present invention, the passage time Tp correlates to the "passage time" of the present invention, the wait time Tw correlates to the "wait time" of the present invention, the prescribed time Te correlates to the "prescribed time" of the present invention, the velocity Vp correlates to the "passage velocity" of the present invention, and the acceleration time Ta correlates to the "acceleration time" of the present invention.

The present invention is not limited to the embodiments noted above, and various modifications can be made to the item described above as long as it does not stray from its key points. For example, the timing and length of the passage time Tp, the wait time Tw, the prescribed time Te, the delay time d and the like can be changed as appropriate.

In light of that, for example, it is also acceptable to set the prescribed time Te for giving discharge instructions to the discharge bias generator 84 during the wait time Tw to be shorter than the delay time. In this case as well, discharge instructions are given to the discharge bias generator 84 for the prescribed time Te within the wait time Tw, so it is possible to execute surface modification processing on the sheet S prior to the passage time Tp that occurs later, and possible to keep the area for which the surface modification processing is insufficient small.

Also, with the embodiment noted above, surface modification processing was executed using corona treatment. However, it is also possible to constitute this so as to execute surface modification processing using a method other than corona treatment, such as plasma processing, for example.

Also, with the embodiment noted above, we described a case of applying the present invention to an inkjet printer using the piezo method. However, it goes without saying that the present invention can also be applied to an inkjet printer using a thermal method.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device comprising:

a support member configured and arranged to support a recording medium conveyed along a conveyance path;

a recording head configured and arranged to eject a liquid on the recording medium while stopped above the support member to record an image;

a surface modifying apparatus configured and arranged to receive a processing execution signal and to execute surface modification processing to modify a surface of the recording medium at a processing position disposed on an upstream side of the support member with respect to the conveyance path;

a conveyor unit configured and arranged to intermittently convey the recording medium from an upstream side of the conveyance path to the support member, and to intermittently pass the recording medium through the processing position at a prescribed passage velocity by feeding the recording medium from the upstream side of the conveyance path to the processing position; and a control unit capable of providing a processing execution signal to the surface modifying apparatus, the control unit being configured to provide the processing execution signal to the surface modifying apparatus for a prescribed time within a wait time from when passage of the recording medium through the processing position stops until the recording medium starts passing through the processing position at the prescribed passage velocity.

2. The image recording device according to claim 1, wherein the control unit is configured to, by providing the processing execution signal to the surface modifying apparatus for the prescribed time until the wait time ends, continuously provide the processing execution signal to the surface modifying apparatus from the wait time over a passage time from when the recording medium starts passing through the processing position at the prescribed passage velocity until the recording medium stops.

3. The image recording device according to claim 1, wherein the control unit is configured to provide the processing execution signal to the surface modifying apparatus for the prescribed time within the wait time when the recording medium has stopped passing through the processing position.

4. The image recording device according to claim 1, wherein the conveyor unit is configured and arranged to pass the recording medium through the processing position at the prescribed passage velocity during a passage time after accelerating the recording medium up to the passage velocity over an acceleration time within the wait time, and the control unit is configured to, by providing the processing execution signal to the surface modifying apparatus for the prescribed time until the acceleration time ends, continuously provide the processing execution signal to the surface modifying apparatus from the wait time over the passage time from when the recording medium starts passing through the processing position at the passage velocity until the recording medium stops.

5. The image recording device according to claim 1, wherein the conveyor unit is configured and arranged to pass the recording medium through the processing position for a predetermined time from when the conveyor unit starts conveying the recording medium to the support member, after stopping the recording medium at the processing position.

6. The image recording device according to claim 1, wherein the conveyor unit is configured and arranged to execute an operation of performing intermittent conveyance of the recording medium to the support member and an operation of intermittently passing the recording medium through the processing position at different timings.

7. An image recording method for ejecting a liquid on a recording medium while stopped above a support member to record an image while the recording medium is being conveyed along a conveyance path, the image recording method comprising:

executing surface modification processing to modify a surface of the recording medium at a processing position disposed on an upstream side of the support member with respect to the conveyance path by using a surface modifying apparatus that receives a processing execution signal to execute the surface modification processing;

intermittently conveying the recording medium from an upstream side of the conveyance path to the support member, and intermittently passing the recording medium through the processing position at a prescribed passage velocity by feeding the recording medium from the upstream side of the conveyance path to the processing position;

providing the processing execution signal to the surface modifying apparatus for a passage time from when the recording medium starts passing through the processing position at the conveyance velocity until the recording medium stops; and providing the processing execution signal to the surface modifying apparatus for a prescribed time within a wait time from when passage of the recording medium through the processing position stops until the recording medium starts passing through the processing position at the prescribed conveyance speed.

* * * * *